US010844584B2

(12) United States Patent
Zhong et al.

(10) Patent No.: US 10,844,584 B2
(45) Date of Patent: Nov. 24, 2020

(54) TOILET DRAINAGE DEVICE

(71) Applicant: XIAMEN R&T PLUMBING TECHNOLOGY CO., LTD., Fujian (CN)

(72) Inventors: Zhijun Zhong, Fujian (CN); Haibin Chen, Fujian (CN); Ziguang Liu, Fujian (CN)

(73) Assignee: XIAMEN R&T PLUMBING TECHNOLOGY CO., LTD, Xiamen (CN)

( * ) Notice: Subject to any disclaimer, the term of this patent is extended or adjusted under 35 U.S.C. 154(b) by 31 days.

(21) Appl. No.: 16/065,695

(22) PCT Filed: Dec. 23, 2016

(86) PCT No.: PCT/CN2016/111729
§ 371 (c)(1),
(2) Date: Jun. 22, 2018

(87) PCT Pub. No.: WO2017/107978
PCT Pub. Date: Jun. 29, 2017

(65) Prior Publication Data

US 2019/0003169 A1 Jan. 3, 2019

(30) Foreign Application Priority Data

Dec. 24, 2015 (CN) ..... 2015 2 1095518 U
Dec. 24, 2015 (CN) ..... 2015 2 1095656 U
(Continued)

(51) Int. Cl.
*E03D 1/34* (2006.01)
*E03D 11/13* (2006.01)

(52) U.S. Cl.
CPC ..... *E03D 1/34* (2013.01); *E03D 11/13* (2013.01)

(58) Field of Classification Search
CPC ..... E03D 1/34; E03D 11/13
See application file for complete search history.

(56) References Cited

U.S. PATENT DOCUMENTS 5,301,374 A * 4/1994 Smiley ..... E03D 11/025 4/341
5,862,538 A * 1/1999 Ho ..... E03D 1/36 137/441
(Continued)

FOREIGN PATENT DOCUMENTS

CN 2459369 11/2001
CN 203247668 10/2013
(Continued)

*Primary Examiner* — J C Jacyna
(74) *Attorney, Agent, or Firm* — Wilmer Cutler Pickering Hale and Dorr LLP

(57) ABSTRACT

The present disclosure relates to a toilet drainage device, which comprises a water tank, a seat body and a mounting seat; the mounting seat is disposed at a bottom wall of the water tank; the mounting seat is provided with a first water inlet, a first water outlet and a second water outlet communicating with each other; wherein, the seat body is provided with an edge channel and a jet channel, wherein the first water inlet is capable of conducting or cutting off with an inner cavity of the water tank; one of the first water outlet and the second water outlet is in communication with the edge channel and the other thereof is in communication with the jet channel. In the aforementioned technical solution, a first water outlet and a second water outlet are provided on the mounting seat, wherein the first water outlet communicates with one of the edge channel or the jet channel, and the second water outlet communicates with the other of the edge channel or the jet channel, so that the water flowing towards the edge channel and the water flowing towards the jet channel start shunting on the mounting seat of the drain valve, with minor energy loss of the water flow and a
(Continued)

relatively stable shunting proportion, so as to realize the purpose of a stable flushing effect. Moreover, the structure is simple, and it is easier to mould the seat body.

14 Claims, 11 Drawing Sheets

(30) Foreign Application Priority Data

| | | |
|---|---|---|
| Dec. 24, 2015 | (CN) | 2015 2 1096099 U |
| Dec. 24, 2015 | (CN) | 2015 2 1096231 U |
| Dec. 24, 2015 | (CN) | 2015 2 1096325 U |
| Dec. 24, 2015 | (CN) | 2015 2 1096425 U |
| Dec. 24, 2015 | (CN) | 2015 2 1096537 U |

(56) References Cited

U.S. PATENT DOCUMENTS

| | | | | |
|---|---|---|---|---|
| 8,438,670 | B2 * | 5/2013 | Grover | E03D 11/08 4/324 |
| 8,640,272 | B2 * | 2/2014 | Morita | E03D 11/08 4/420 |
| 9,487,941 | B2 * | 11/2016 | Grover | E03D 11/08 |
| 9,487,942 | B2 * | 11/2016 | Guo | E03D 1/38 |
| 2003/0101509 | A1 * | 6/2003 | Noburu | E03D 5/00 4/425 |
| 2004/0040080 | A1 * | 3/2004 | Prokopenko | E03D 1/34 4/420 |
| 2012/0284910 | A1 * | 11/2012 | Shirakawa | E03D 11/08 4/420 |
| 2013/0185859 | A1 * | 7/2013 | Yu | E03D 1/32 4/415 |
| 2017/0030062 | A1 * | 2/2017 | Conrad | E03D 5/092 |

FOREIGN PATENT DOCUMENTS

| | | |
|---|---|---|
| CN | 203924289 | 11/2014 |
| CN | 205314185 | 6/2016 |
| CN | 205314186 | 6/2016 |
| CN | 205314188 | 6/2016 |
| CN | 205329812 | 6/2016 |
| CN | 205348346 | 6/2016 |
| CN | 205369464 | 7/2016 |
| CN | 205444362 | 8/2016 |
| JP | 2015068123 A | 4/2015 |

* cited by examiner

TOILET DRAINAGE DEVICE

FIELD OF THE INVENTION

The present disclosure relates to the field of sanitary ware, and in particular to a toilet drainage device.

DESCRIPTION OF RELATED ART

The toilet comprises a water tank and a seat body, wherein the seat body is internally provided with an edge channel for scouring the inner wall of the toilet bowl and a jet channel for spraying at the bottom of the toilet bowl. Before the edge channel and the jet channel, there is a common channel with which the drainage channel of the drain valve within the water tank communicates. The water flow flows from the drainage channel of the drain valve to the common channel on the seat body, and enters the edge channel and the jet channel after being shunted at an extremity of the common channel, so as to respectively scour and spray the toilet bowl.

The inventor has found that the related art is at least present with the following problems: the seat body of such structure is complicatedly structured and difficult to mould, and there is a great energy loss of the water flow as the shunting starts at the seat body. Moreover, the shunting proportion is hard to control, and the flushing effect is unstable.

SUMMARY

The present disclosure proposes a toilet drainage device for optimizing the structure of the existing toilet drainage device.

According to one aspect of the present disclosure, some embodiments of the present disclosure provide a toilet drainage device, which comprises a water tank, a seat body and a mounting seat; the mounting seat is disposed at a bottom wall of the water tank and provided with a first water inlet, a first water outlet and a second water outlet communicating with each other; wherein, the seat body is provided with an edge channel and a jet channel, wherein the first water inlet is switchable conducting or cutting off with an inner cavity of the water tank; one of the first water outlet and the second water outlet is in communication with the edge channel and the other thereof is in communication with the jet channel. In the aforementioned technical solution, a first water outlet and a second water outlet are provided on the mounting seat, wherein the first water outlet communicates with one of the edge channel or the jet channel, and the second water outlet communicates with the other of the edge channel or the jet channel, so that the water flowing towards the edge channel and the water flowing towards the jet channel start shunting on the mounting seat of the drain valve, with minor energy loss of the water flow and a relatively stable shunting proportion, so as to realize the purpose of a stable flushing effect. Moreover, the structure is simple, and it is easier to mould the seat body.

In some embodiments, the first water inlet is located higher than the first water outlet and the second water outlet, and the first water outlet is located higher than that of the second water outlet or flush with that of the second water outlet.

In some embodiments, the mounting seat comprises a drainage channel, at which the first water inlet, the first water outlet and the second water outlet are disposed.

In some embodiments, the drainage channel has a lateral wall which has a diverting wall tilted inward from top to bottom, wherein the first water outlet is disposed at the diverting wall, and the second water outlet is disposed at a bottom end of the drainage channel. In the aforementioned technical solution, the drainage channel has a lateral wall which has a diverting wall tilted inward from top to bottom, and the first water outlet is disposed on the diverting wall and communicates with one of the jet channel and the edge channel, so that the lateral outflow and drainage are more smooth, and the shunting is more stable.

In some embodiments, the mounting seat comprises a drainage channel and an extension channel in communication, wherein the first water inlet is disposed at the drainage channel, the first water outlet is disposed at the drainage channel or the extension channel; the second water outlet is disposed at the extension channel; a cross-sectional dimension of the extension channel is smaller than that of the drainage channel. In the aforementioned technical solution, an extension channel is provided below the drainage channel, and the circulation section of the extension channel is smaller than that of the drainage channel. If the first water outlet is disposed on the drainage channel, the second outlet is disposed on the extension channel. The water flow enters a small section from a large section. On the one hand, there are a smaller flow velocity within the drainage channel and a relatively slower water flow at the lateral outflow. When the first water outlet is in communication with the edge channel, the edge channel presents a better steady flow effect. On the other hand, the extension channel forms a larger flow velocity and generate greater kinetic energy. When the second water outlet communicates with the jet channel, the jet channel presents a better scouring effect. If the first water outlet and the second water outlet are both disposed on the extension channel, the water flow enters a small section from a large section, and both of the outlets form a larger flow velocity and generate greater kinetic energy, thereby improving the water pressure and presenting a better scouring effect.

In some embodiments, the mounting seat comprises a drainage channel, the drainage channel comprising an outer sleeve and an inner sleeve that are nested, wherein at least one of a top end opening of the outer sleeve and a top end opening of the inner sleeve serves as the first water inlet, the first water outlet is disposed at the outer sleeve, and the second water outlet is disposed at the inner sleeve.

In some embodiments, the first water inlet is disposed at a top end of the outer sleeve, a top end of the inner sleeve is lower than that of the outer sleeve, the inner sleeve is provided with an inner water inlet communicating with the first water inlet, the inner cavity of the inner sleeve forms an internal drainage channel, a passing gap between the outer sleeve and the inner sleeve forms an external drainage channel, the first water outlet is in communication with the external drainage channel, and the second water outlet is in communication with the internal drainage channel.

In some embodiments, the second water outlet is disposed at a bottom end of the inner sleeve, and the first water outlet is disposed at a bottom end or lateral wall of the outer sleeve.

In some embodiments, the mounting seat comprises a drainage channel, the drainage channel is provided with the first water inlet, the first water outlet and the second water outlet, wherein the drainage channel comprise a larger section channel at an upper portion, a diverting channel tilted inwardly from top to bottom and a smaller section channel at a lower portion, the diverting channel has an upper end connected to the larger section channel and a lower end connected to the smaller section channel, the first water outlet is disposed at a lateral wall of the smaller section channel, and the second water outlet is disposed at a bottom end of the smaller section channel. In the aforementioned technical solution, the drainage channel comprises a larger section channel located at an upper portion, a diverting channel tilted inwardly from top to bottom and a smaller section channel located at a lower portion, the diverting channel has an upper end connected to the larger section channel and a lower end connected to the smaller section channel, the first water outlet is disposed in a lateral wall of the smaller section channel, and the second water outlet is disposed at a bottom end of the smaller section channel, which is favorable for expelling the air within the drainage channel, and making a better flushing effect.

In some embodiments, the mounting seat comprises a drainage channel, the drainage channel is provided with the first water inlet, the first water outlet and the second water outlet; the drainage channel has a horizontal lower wall at a bottom end, the second water outlet is disposed at an intermediate portion of the horizontal lower wall, the first water outlet is disposed at an outer periphery of the intermediate portion of the horizontal lower wall. In the aforementioned technical solution, a horizontal lower wall is provided at a bottom end of the drainage channel, and the second water outlet and the first water outlet are respectively disposed at an intermediate portion and an outer periphery of the intermediate portion of the horizontal lower wall, so that the outflow directions of the two water outlets are both downwards, thus improving the gravitational reinforcement effect, and presenting a better scouring effect.

In some embodiments, the second water outlet is provided with a downwardly extending extension channel, which communicates with the jet channel. In the aforementioned technical solution, the second water outlet is provided with a downwardly extending extension channel, which communicates with the jet channel, so that the jet channel presents a more stable outflow and a better scouring effect.

In some embodiments, the first water outlet communicates with the edge channel, and the second water outlet communicates with the jet channel. In the aforementioned technical solution, the first water outlet communicates with the edge channel, and the second water outlet communicates with the jet channel. When the second water outlet is located lower than the first water outlet, the water of the jet channel presents greater gravitational potential energy, and a better flushing effect.

In some embodiments, the bottom wall of the water tank is provided with a first mounting hole for mounting the mounting seat, the seat body is correspondingly provided with a second mounting hole for mounting the mounting seat, the first water inlet is located above the first mounting hole, the first water outlet is located between the first mounting hole and the second mounting hole; the second water outlet is located between the first mounting hole and the second mounting hole, or the second water outlet is located below the second mounting hole. In the aforementioned technical solution, the bottom wall of the water tank is provided with a first mounting hole for mounting a mounting seat of the drain valve, and the seat body is also correspondingly provided with a second mounting hole for mounting a mounting seat of the drain valve, so that the mounting seat after the flushing channel is prolonged attain a reliable positioning, and a more firm mounting structure.

In some embodiments, a cavity is formed between the first mounting hole and the second mounting hole, and there is provided with at least one said first water outlet, which communicates with the edge channel through the cavity. In the aforementioned technical solution, a cavity is formed between the first mounting hole and the second mounting hole, and the first water outlet communicates with the edge channel through the cavity, so that the edge channel presents a more smooth drainage and a more uniform shunting.

In some embodiments, the jet channel has a cross-sectional area that is less than that of the first water inlet. In the aforementioned technical solution, the jet channel which has a cross-sectional area that is less than that of the first water inlet, reinforce the scouring strength of the jet channel, so as to improve the flushing effect.

Reference Signs:

100. water tank; 110. drain valve; 111. watertight assembly; 120. mounting seat; 121. first mounting hole; 122. second mounting hole; 123. cavity; 124. inner sleeve; 125. outer sleeve; 130. drainage channel; 131. first water inlet; 132. first water outlet; 133. second water outlet; 134. extension channel; 135. diverting wall; 136. external drainage channel; 137. inner water inlet; 138. internal drainage channel; 139. large section channel; 140. diverting channel; 141. small section channel; 142. horizontal lower wall; 200. seat body; 210. edge channel; 1241. envelope; 1242. groove; 1251. barb.

DESCRIPTION OF THE INVENTION

Figure 1:
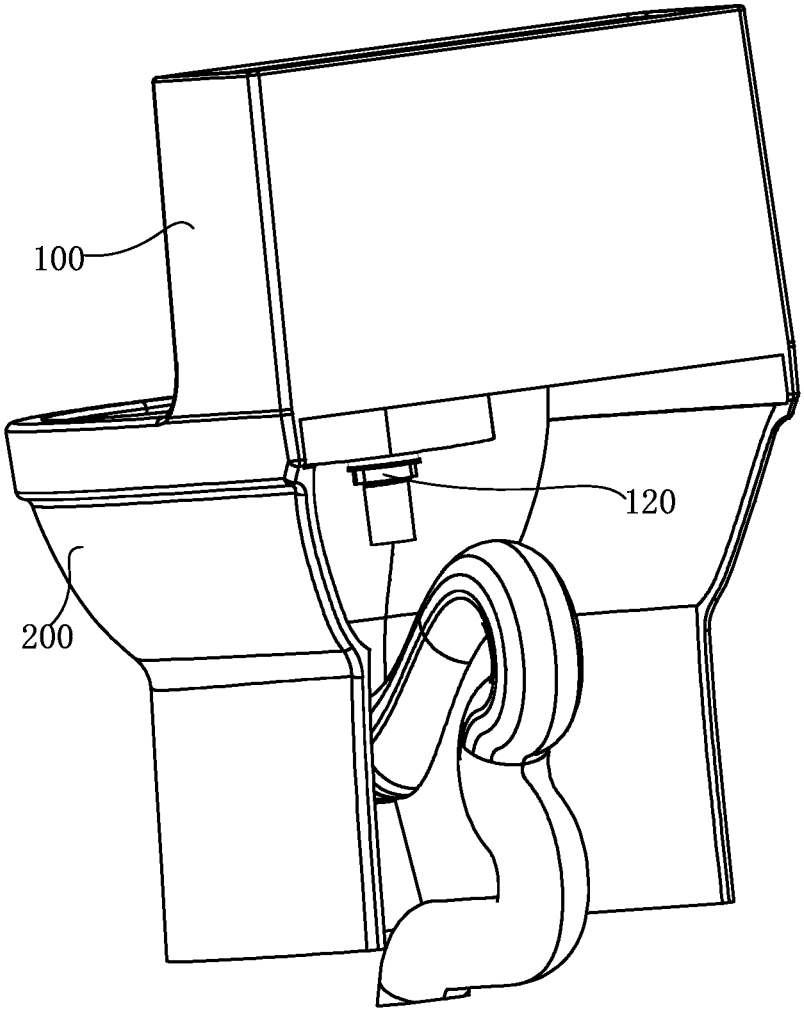
FIG. 1 is a schematic view of a three-dimensional structure of the toilet drainage device provided by a first embodiment of the present disclosure.
Figure 2:
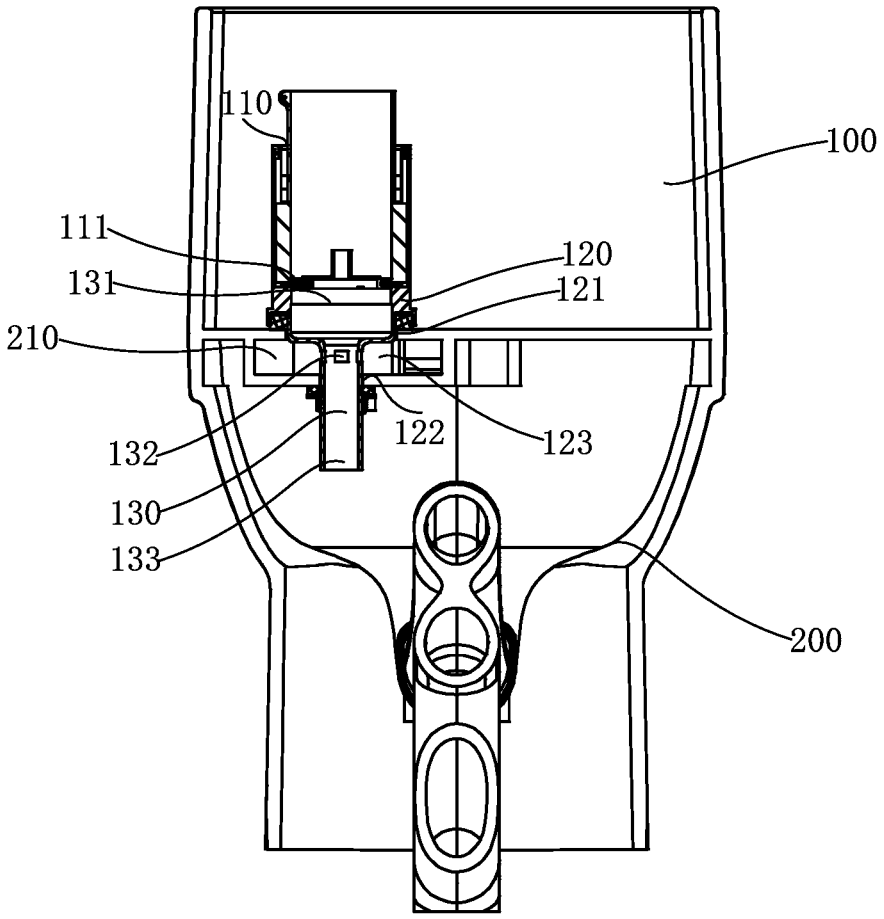
FIG. 2 is a schematic view of a sectional structure of the toilet drainage device provided by a first embodiment of the present disclosure.

As shown in FIGS. 1 and 2, some embodiments of the present disclosure provide a toilet drainage device with two water outlets, which comprises a water tank (or referred thereto as "toilet water tank", also as in other embodiments) 100 and a seat body (or referred thereto as "toilet seat body", also as in other embodiments). The water tank 100 is jointed above the seat body 200 and internally provided with a drain valve 110. The seat body 200 is internally provided with an edge channel (or referred thereto as "flushing annular channel", also as in other embodiments) 210 for scouring the inner wall of the toilet bowl, and a jet channel (not shown in the figures) for spraying the bottom of the toilet bowl. The mounting seat (or referred thereto as "mounting base seat", also as in other embodiments) 120 of the drain valve 110 is fixedly disposed on the bottom wall of the water tank 100. The mounting seat 120 is provided with a drainage channel 130 which is sequentially provided with a first water inlet (or referred thereto as "upper water inlet", also as in other embodiments) 131, a first water outlet (or referred thereto as "lateral water outlet", also as in other embodiments) 132, a second water outlet (or referred thereto as "lower water outlet", also as in other embodiments) 133 communicating with each other from top to bottom. The first water inlet 131 communicates with the inner cavity of the water tank and is in sealed fit or in separated fit with the watertight assembly 111 of the drain valve 110. The first water outlet 132 communicates with one of the jet channel and the edge channel 210. The second water outlet 133 communicates with the other of the jet channel and the edge channel 210. In some embodiments, the first water outlet 132 communicates with the edge channel 210, and the second water outlet 133 communicates with the jet channel.

Moreover, the bottom wall of the water tank 100 is provided with a first mounting hole (or referred thereto as "upper mounting hole", also as in other embodiments) 121 for mounting the mounting seat 120 of the drain valve 110. The seat body 200 is also correspondingly provided with a second mounting hole (or referred thereto as "lower mounting hole", also as in other embodiments) 122. The first water inlet 131 is located above the first mounting hole 121, and the first water outlet 132 is located between the first mounting hole 121 and the second mounting hole 122. The second water outlet 133 protrudes from the second mounting hole 122 and is located below the second mounting hole 122. A cavity 123 is formed between the first mounting hole 121 and the second mounting hole 122. There is provided with one or more first water outlets 132 are provided. In some embodiments, there are provided with two or more first water outlets 132, which communicate with the edge channel 210 through the cavity 123.

In order to obtain a better flushing effect, in some embodiments, the jet channel has a cross-sectional area that is smaller than that of the first water inlet 131 of the drainage channel 130.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position, the first water outlet 132 corresponds to the edge channel 210 in position, and the second water outlet 133 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131. The water in the water tank 100 enters the drainage channel 130 through the first water inlet 131, and respectively produces a shunt at the first water outlet 132 and the second water outlet 133, so that one part of the water enters the edge channel 210 from the first water outlet 132, and the other part of the water enters the jet channel from the second water outlet 133.

It is necessary to explain that, the specific structure of the drainage channel 130 is designed into different shapes according to actual needs. The opening position of the first water outlet 132 is mainly matched with the structure and position of the edge channel 210 of the seat body 200.

Figure 3:
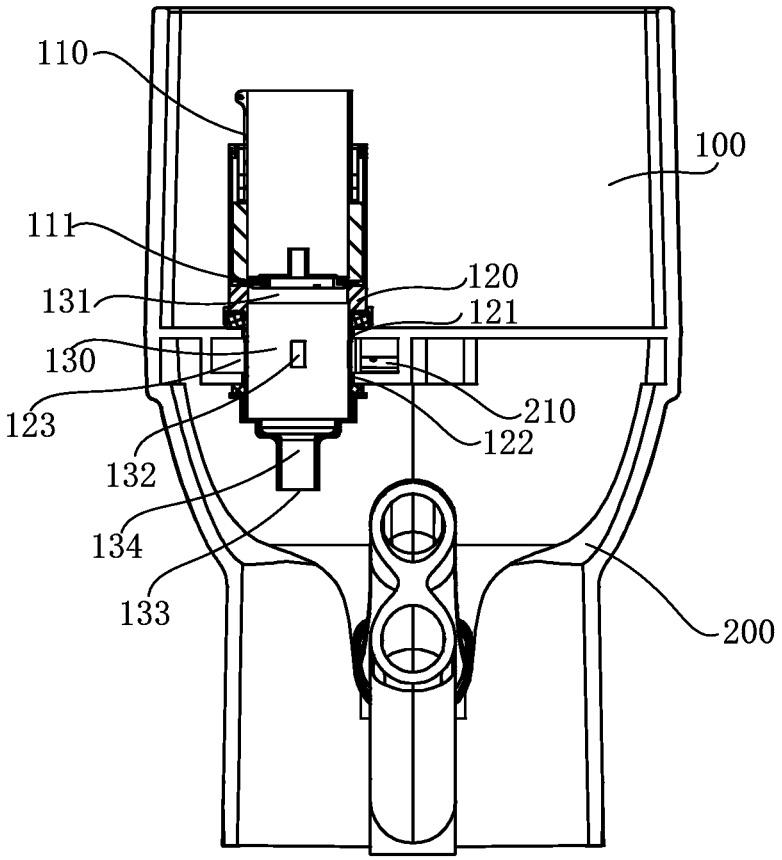
FIG. 3 is a schematic view of a sectional structure of the toilet drainage device provided by a second embodiment of the present disclosure.

As shown in FIGS. 1 and 3, some embodiments provide a steady-flow toilet drainage device with two water outlets, which comprises a water tank 100 and a seat body 200. The water tank 100 of some embodiments is jointed above the seat body 200 and internally provided with a drain valve 110. The seat body 200 is internally provided with an edge channel 210 for scouring the inner wall of the toilet bowl and a jet channel for spraying towards the bottom of the toilet bowl (not illustrated). The mounting seat 120 of the drain valve 110 is fixedly disposed on the bottom wall of the water tank 100. The mounting seat 120 has a drainage channel 130 and an extension channel 134 connected below the drainage channel 130, and the extension channel 134 has a circulation section that is less than that of the drainage channel 130. The drainage channel 130 is provided with a first water inlet 131 that is in communication with the inner cavity of the water tank 100 and is in sealed fit or separated fit with the watertight assembly 111 of the drainage valve 110, and the lateral wall of the drainage channel 130 below the first water inlet 131 is provided with a first water outlet 132 communicating with the first water inlet 131. The extension channel 134 is provided with a second water outlet 133 communicating with the first water inlet 131. The first water outlet 132 communicates with one of the jet channel and the edge channel 210, and the second water outlet 133 communicates with the other of the jet channel and the edge channel 210. In some embodiments, the first water outlet 132 communicates with the edge channel 210, and the second water outlet 133 communicates with the jet channel.

Moreover, the bottom wall of the water tank 100 is provided with a first mounting hole 121 for mounting a mounting seat 120 of the drain valve 110, and the seat body 200 is also correspondingly provided with a second mounting hole 122 for mounting a mounting seat 120 of the drain valve 110. The first water inlet 131 is located above the first mounting hole 121, and the first water outlet 132 is located between the first mounting hole 121 and the second mounting hole 122. The second water outlet 133 protrudes from the second mounting hole 122 and is located below the second mounting hole 122. A cavity 123 is formed between the first mounting hole 121 and the second mounting hole 122. There is provided with one or more first water outlets 132 are provided. In some embodiments, there are provided with two or more first water outlets 132 spacedly provided in a circumferential direction, which communicate with the edge channel 210 through the cavity 123.

In order to obtain a better flushing effect, in some embodiments, the jet channel has a cross-sectional area that is smaller than that of the first water inlet 131 of the drainage channel 130.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position, and the first water outlet 132 corresponds to the edge channel 210 in position. The second water outlet 133 on the extension channel 134 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131 of the drainage channel 130. The water in the water tank 100 enters the drainage channel 130 through the first water inlet 131, and is shunted so that one part of the water enters the edge channel 210 from the first water outlet 132 on the lateral wall of the drainage channel 130, and the other part of the water flows into the extension channel 134, and enters the jet channel from the second water outlet 133 on the extension channel 134.

It is necessary to explain that, the specific structure of the drainage channel 130 is designed into different shapes according to actual needs. The opening position of the first water outlet 132 is mainly matched with the structure and position of the edge channel 210 of the seat body 200.

Figure 4:
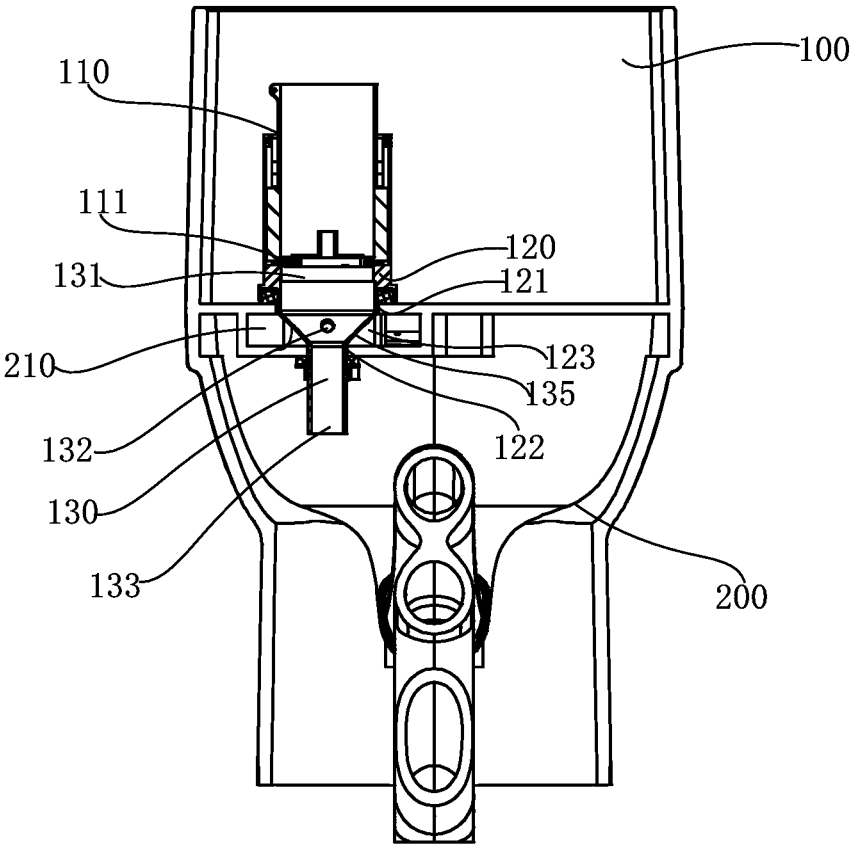
FIG. 4 is a schematic view of a sectional structure of the toilet drainage device provided by a third embodiment of the present disclosure.

As shown in FIGS. 1 and 4, some embodiments provide a toilet drainage device with an improved lateral outflow, which comprises a water tank 100 and a seat body 200. The water tank 100 of some embodiments is jointed above the seat body 200 and internally provided with a drain valve 110. The seat body 200 is internally provided with an edge channel 210 for scouring the inner wall of the toilet bowl and a jet channel for spraying towards the bottom of the toilet bowl (not illustrated). The mounting seat 120 of the drain valve 110 is fixedly disposed on the bottom wall of the water tank 100. The mounting seat 120 has a drainage channel 130. The drainage channel 130 is sequentially provided with a first water inlet 131, a first water outlet 132, a second water outlet 133 communicating with each other from top to bottom. The drainage channel 130 has a lateral wall which has a diverting wall 135 tilted inward from top to bottom, and the first water inlet 131 is in communication with the inner cavity of the water tank and is in sealed fit or separated fit with the watertight assembly 111 of the drainage valve 110. The first water outlet 132 is disposed on the diverting wall 135 and communicates with one of the jet channel and the edge channel 210, and the second water outlet 133 communicates with the other of the jet channel and the edge channel 210. In some embodiments, the first water outlet 132 communicates with the edge channel 210, and the second water outlet 133 communicates with the jet channel.

Moreover, the bottom wall of the water tank 100 is provided with a first mounting hole 121 for mounting a mounting seat 120 of the drain valve 110, and the seat body 200 is also correspondingly provided with a second mounting hole 122 for mounting a mounting seat 120 of the drain valve 110. The first water inlet 131 is located above the first mounting hole 121, and the first water outlet 132 is located between the first mounting hole 121 and the second mounting hole 122. The second water outlet 133 protrudes from the second mounting hole 122 and is located below the second mounting hole 122. A cavity 123 is formed between the first mounting hole 121 and the second mounting hole 122. There is provided with one or more first water outlets 132 are provided. In some embodiments, there are provided with two or more first water outlets 132 spacedly provided in a circumferential direction, which communicate with the edge channel 210 through the cavity 123.

In order to obtain a better flushing effect, in some embodiments, the jet channel has a cross-sectional area that is smaller than that of the first water inlet 131 of the drainage channel 130.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position, the first water outlet 132 corresponds to the edge channel 210 in position, and the second water outlet 133 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131. The water in the water tank 100 enters the drainage channel 130 through the first water inlet 131, and respectively produces a shunt at the first water outlet 132 and the second water outlet 133, so that one part of the water enters the edge channel 210 from the first water outlet 132 on the diverting wall of the drainage channel 130, and the other part of the water enters the jet channel from the second water outlet 133.

It is necessary to explain that, the specific structure of the drainage channel 130 is designed into different shapes according to actual needs. The opening position of the first water outlet 132 is mainly matched with the structure and position of the edge channel 210 of the seat body 200.

Figure 5:
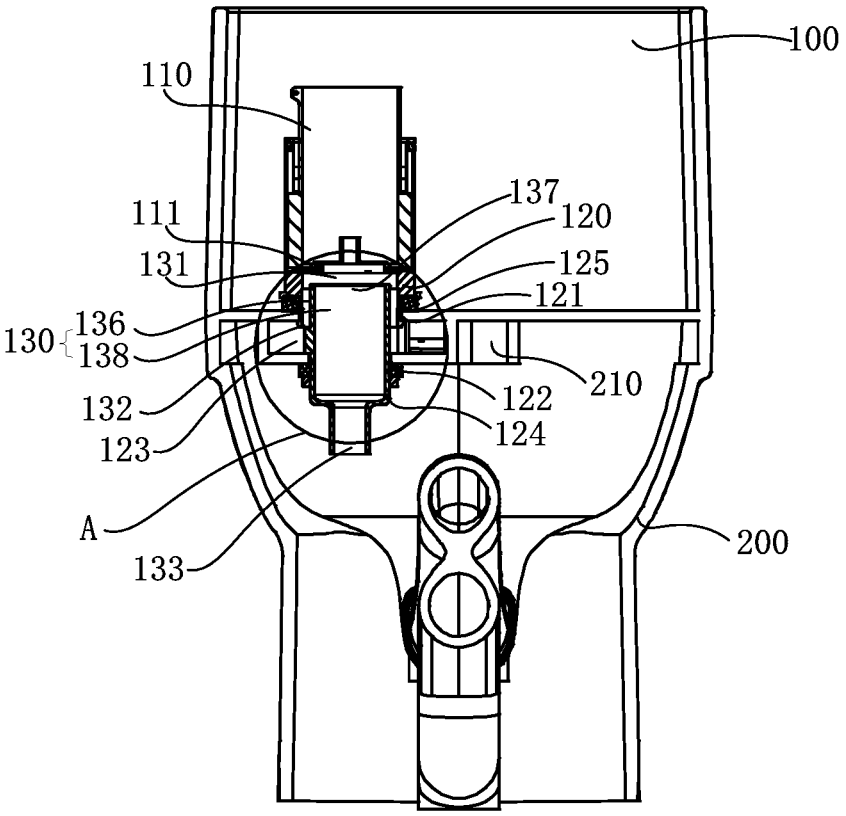
FIG. 5 is a schematic view of a sectional structure of the toilet drainage device provided by a fourth embodiment of the present disclosure.
Figure 6:
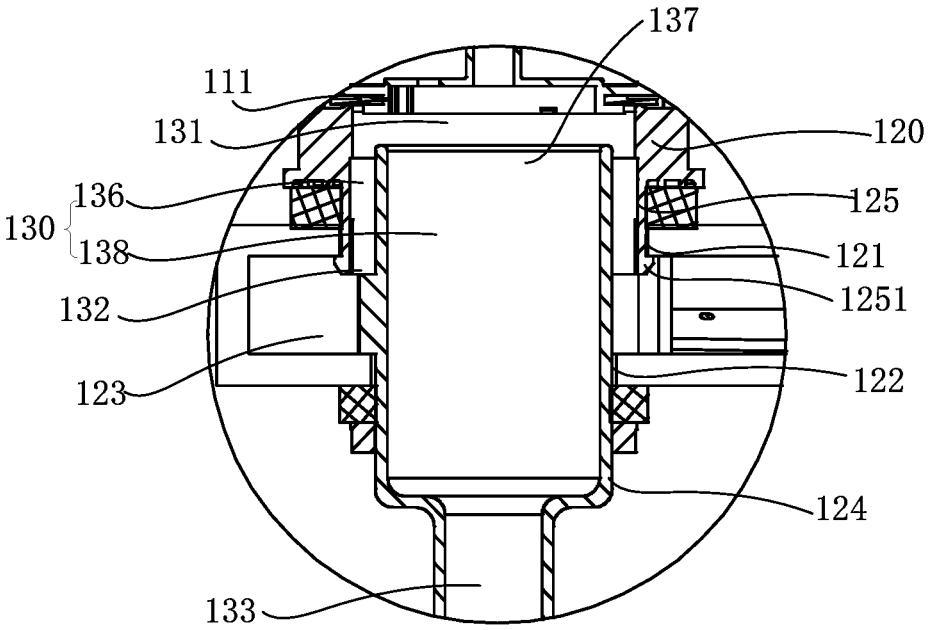
FIG. 6 is a locally enlarged schematic view of A in FIG. 5.
Figure 7:
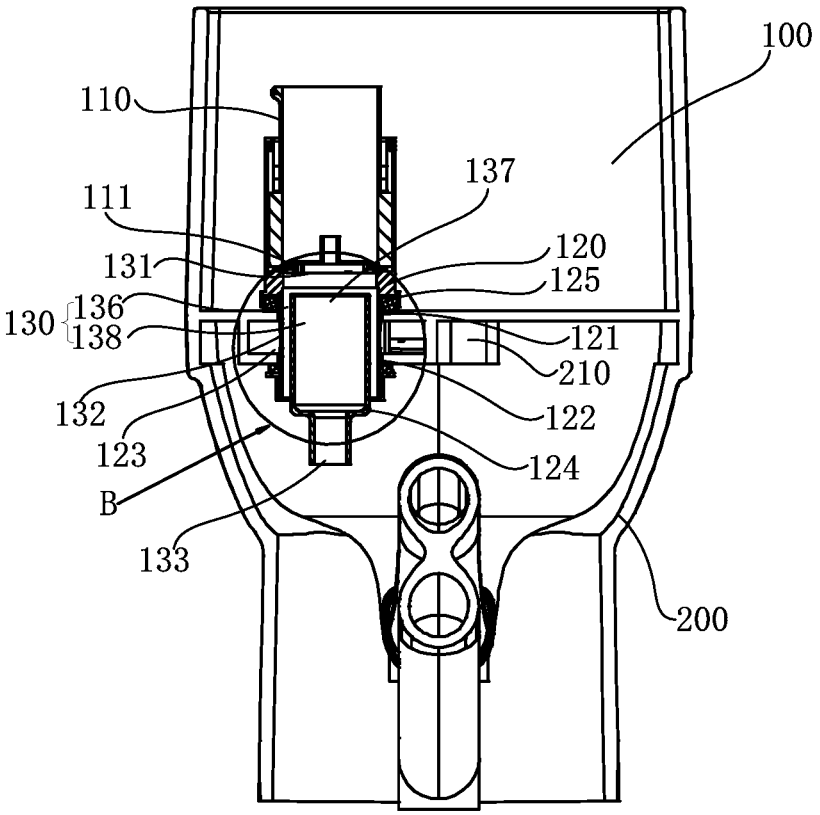
FIG. 7 is a schematic view of a sectional structure of the toilet drainage device provided by a fifth embodiment of the present disclosure.
Figure 8:
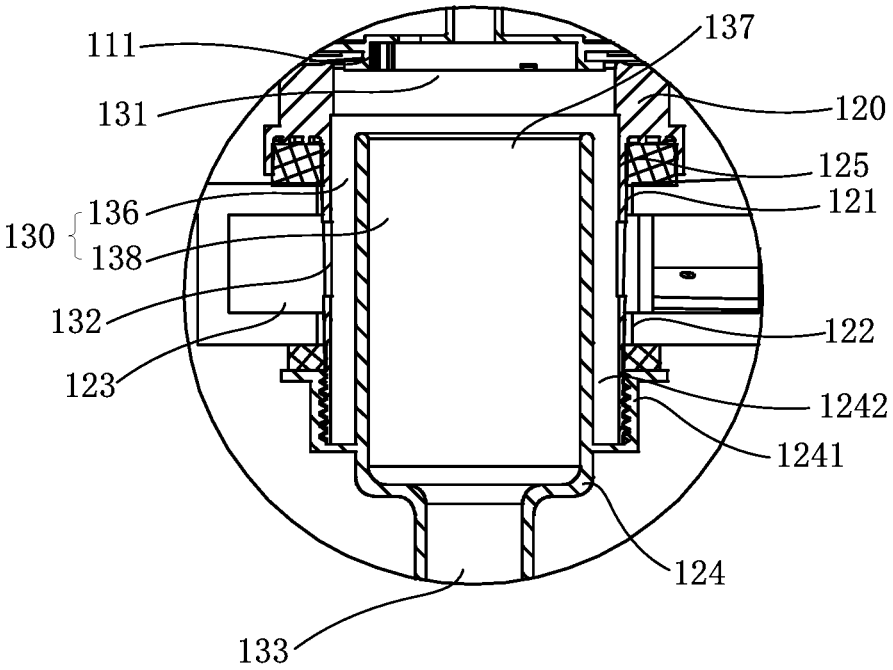
FIG. 8 is a locally enlarged schematic view of B in FIG. 7.

In the fourth embodiments shown in FIGS. 1, 5 and 6 and the fifth embodiments shown in FIGS. 1, 7 and 8, the fourth embodiments and the fifth embodiments provide a toilet drainage device with two sleeves, which comprises a water tank 100 and a seat body 200. The water tank 100 of some embodiments is jointed above the seat body 200 and the water tank 100 is internally provided with a drain valve 110. The seat body 200 is internally provided with an edge channel 210 for scouring the inner wall of the toilet bowl and a jet channel for spraying towards the bottom of the toilet bowl (not illustrated). The mounting seat 120 of the drain valve 110 is fixedly disposed on the bottom wall of the water tank 100. The mounting seat 120 is provided with a drainage channel 130, which is formed by sleeving the outer sleeve 125 and the inner sleeve 124 to each other. The drainage channel 130 is sequentially provided with a first water inlet 131, a first water outlet 132, a second water outlet 133 communicating with each other from top to bottom. The outer sleeve 125 is provided with a first water outlet 132, and the inner sleeve 124 is provided with a second water outlet 133. The first water inlet 131 is in communication with the inner cavity of the water tank and is in sealed fit or separated fit with the watertight assembly 111 of the drainage valve 110. The first water outlet 132 communicates with one of the jet channel and the edge channel 210, and the second water outlet 133 communicates with the other of the jet channel and the edge channel 210. In some embodiments, the first water outlet 132 communicates with the edge channel 210, and the second water outlet 133 communicates with the jet channel.

Moreover, the bottom wall of the water tank 100 is provided with a first mounting hole 121 for mounting the mounting seat 120 of the drain valve 110. The seat body 200 is also correspondingly provided with a second mounting hole 122. The first water inlet 131 is located above the first mounting hole 121, and the first water outlet 132 is located between the first mounting hole 121 and the second mounting hole 122. The second water outlet 133 protrudes from the second mounting hole 122 and is located below the second mounting hole 122. A cavity 123 is formed between the first mounting hole 121 and the second mounting hole 122. There is provided with one or more first water outlets 132 are provided. In some embodiments, there are provided with two or more first water outlets 132 spacedly provided in a circumferential direction, which communicate with the edge channel 210 through the cavity 123.

In order to obtain a better flushing effect, in some embodiments, the jet channel has a cross-sectional area that is smaller than that of the first water inlet 131 of the drainage channel 130.

In some embodiments, the first water inlet 131 is disposed at an upper end of the outer sleeve 125. The upper end of the inner sleeve 124 is lower than that of the outer sleeve 125, and provided with an inner water inlet 137 communicating with the first water inlet 131. The inner cavity of the inner sleeve 124 forms an internal drainage channel 138, and a passing gap between the outer sleeve 125 and the inner sleeve 124 forms an external drainage channel 136. The first water outlet 132 communicates with the external drainage channel 136, and the second water outlet 133 communicates with the internal drainage channel 138. It is understood that, the upper end of the outer sleeve 125 and the upper end of the inner sleeve 124 is provided with the first water inlet 131 at the same time. At this time, the watertight assembly 111 of the drain valve 110 simultaneously seals the upper end of the outer sleeve 125 and the upper end of the inner sleeve 124. Alternatively, it is also possible that, the upper end of the inner sleeve 124 is higher than that of the outer sleeve 125, while the first water inlet 131 is disposed at the upper end of the inner sleeve 124. At this time, the upper end of the outer sleeve 125 does not form an opening, but is in sealed connection with the inner sleeve 124, while the outer sleeve 125 is disposed on a lateral wall thereof and communicates with the inner sleeve 124 through the opening on its lateral wall, so that it is also feasible in this manner.

In the fourth embodiments as shown in FIGS. 5 and 6, the second water outlet 133 thereof is disposed at the lower end of the inner sleeve 124, and the first water outlet 132 is disposed at the lower end of the outer sleeve 125. Specifically, the lower end of the outer sleeve 125 is provided with a barb 1251, which is hooked with the lower surface of the first mounting hole 121, and the lower end of the outer sleeve 125 communicates with the cavity 123, so that the lower end of the outer sleeve 125 forms a first water outlet 132.

Moreover, different from the fourth embodiments, in the fifth embodiments as shown in FIGS. 7 and 8, the second water outlet 133 thereof is disposed at the lower end of the inner sleeve 124, and the first water outlet 132 is disposed at a lateral wall of the outer sleeve 125. The lower end of the outer sleeve 125 is in sealingly fixed fit with the exterior of the inner sleeve 124 by threads. Specifically, the outer wall of the inner sleeve 124 moulds an envelope 1241, and a groove 1242 capable of receiving a lower end of the outer sleeve 125 is formed between the envelope 1241 and the outer wall of the inner sleeve 124. The inner wall of the envelope 1241 is provided with an internal thread, and the outer wall at the lower end of the outer sleeve 125 is provided with an external thread mated with the internal thread.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position, the first water outlet 132 corresponds to the edge channel 210 in position, and the second water outlet 133 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131. The water in the water tank 100 produces a shunt at the first water inlet 131, so that one part of the water enters the external drainage channel 136 and enters the edge channel 210 from the first water outlet 132, and the other part of water enters the internal drainage channel 138 from the inner water inlet 137 and enters the jet channel from the second water outlet 133.

It is necessary to explain that, the specific structure of the drainage channel 130 is designed into different shapes according to actual needs. The opening position of the first water outlet 132 is mainly matched with the structure and position of the edge channel 210 of the seat body 200. The outer sleeve 125 and the inner sleeve 124 uses an integrally formed structure, or uses a fixed connection by threaded mating, or use a fixed connection by clamping and the like.

Figure 9:
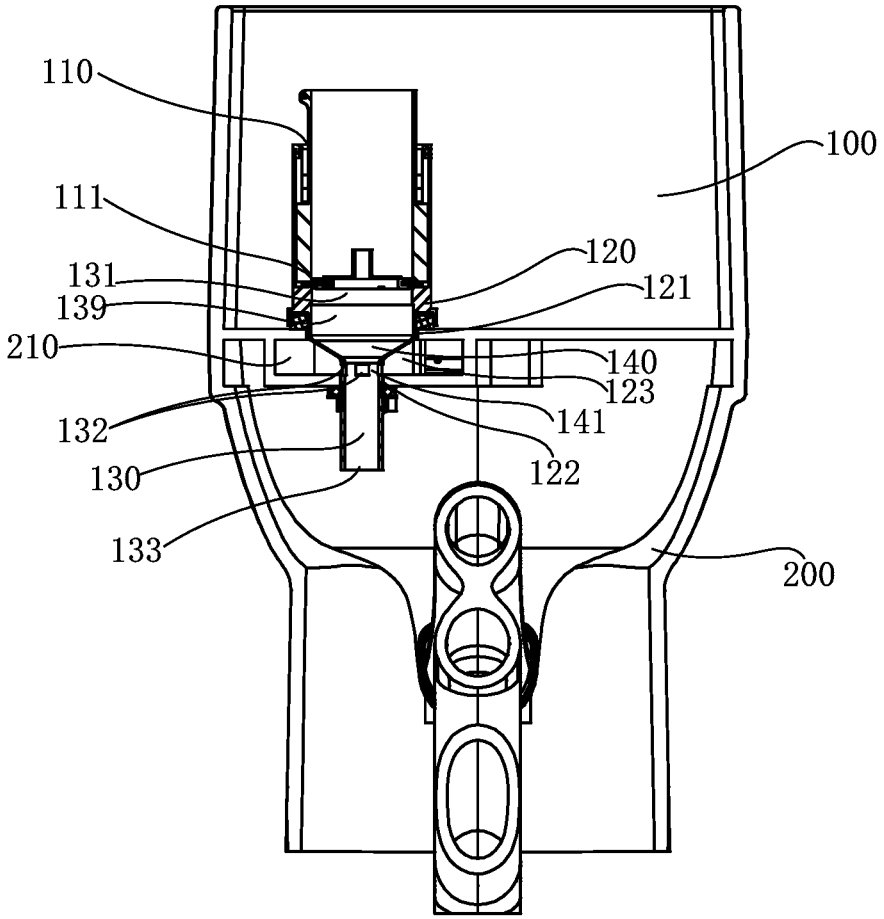
FIG. 9 is a schematic view of a sectional structure of the toilet drainage device provided by a sixth embodiment of the present disclosure.

As shown in FIGS. 1 and 9, some embodiments provide a toilet drainage device with a stable lateral outflow, which comprises a water tank 100 and a seat body 200. The water tank 100 of some embodiments is jointed above the seat body 200 and internally provided with a drain valve 110. The seat body 200 is internally provided with an edge channel 210 for scouring the inner wall of the toilet bowl and a jet channel for spraying towards the bottom of the toilet bowl (not illustrated). The mounting seat 120 of the drain valve 110 is fixedly disposed on the bottom wall of the water tank 100. The mounting seat 120 has a drainage channel 130. The drainage channel 130 is sequentially provided with a first water inlet 131, a first water outlet 132, a second water outlet 133 communicating with each other from top to bottom. In some embodiments, the drainage channel 130 comprises a larger section channel 139 located at an upper portion, a diverting channel 140 tilted inwardly from top to bottom and a smaller section channel 141 located at a lower portion, the diverting channel 140 comprises an upper end connected to the larger section channel 139 and a lower end connected to the smaller section channel 141. The first water inlet 131 is in communication with the inner cavity of the water tank and is in sealed fit or separated fit with the watertight assembly 111 of the drainage valve 110. The first water outlet 132 is disposed on the lateral wall of the smaller section channel 141 at a lower end of the diverting channel 140 and communicates with one of the jet channel and the edge channel 210, and the second water outlet 133 communicates with the other of the jet channel and the edge channel 210. In some embodiments, the first water outlet 132 communicates with the edge channel 210, and the second water outlet 133 communicates with the jet channel.

Herein, the smaller section and the larger section, which are relatively defined, mean that the larger section channel 139 has a sectional dimension that is greater than that of the smaller section channel 141, rather than referring to a specific dimension.

Moreover, the bottom wall of the water tank 100 is provided with a first mounting hole 121 for mounting a mounting seat 120 of the drain valve 110, and the seat body 200 is also correspondingly provided with a second mounting hole 122 for mounting a mounting seat 120 of the drain valve 110. The first water inlet 131 is located above the first mounting hole 121, and the first water outlet 132 is located between the first mounting hole 121 and the second mounting hole 122. The second water outlet 133 protrudes from the second mounting hole 122 and is located below the second mounting hole 122. A cavity 123 is formed between the first mounting hole 121 and the second mounting hole 122. There is provided with one or more first water outlets 132 are provided. In some embodiments, there are provided with two or more first water outlets 132 spacedly provided in a circumferential direction, which communicate with the edge channel 210 through the cavity 123.

In order to obtain a better flushing effect, in some embodiments, the jet channel has a cross-sectional area that is smaller than that of the first water inlet 131 of the drainage channel 130.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position, the first water outlet 132 corresponds to the edge channel 210 in position, and the second water outlet 133 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131. The water in the water tank 100 enters the larger section channel 139 of the drainage channel 130 through the first water inlet 131, and is diverted by the diverting channel 140 from the larger section channel 139 to enter the smaller section channel 141, and produces a shunt at the smaller section channel 141, so that one part of the water enters the edge channel 210 from the first water outlet 132 on the lateral wall of the smaller section channel 141, and the other part of the water enters the jet channel from the second water outlet 133 located at the lower end of the smaller section channel 141.

It is necessary to explain that, the specific structure of the drainage channel 130 is designed into different shapes according to actual needs. The opening position of the first water outlet 132 is mainly matched with the structure and position of the edge channel 210 of the seat body 200.

Figure 10:
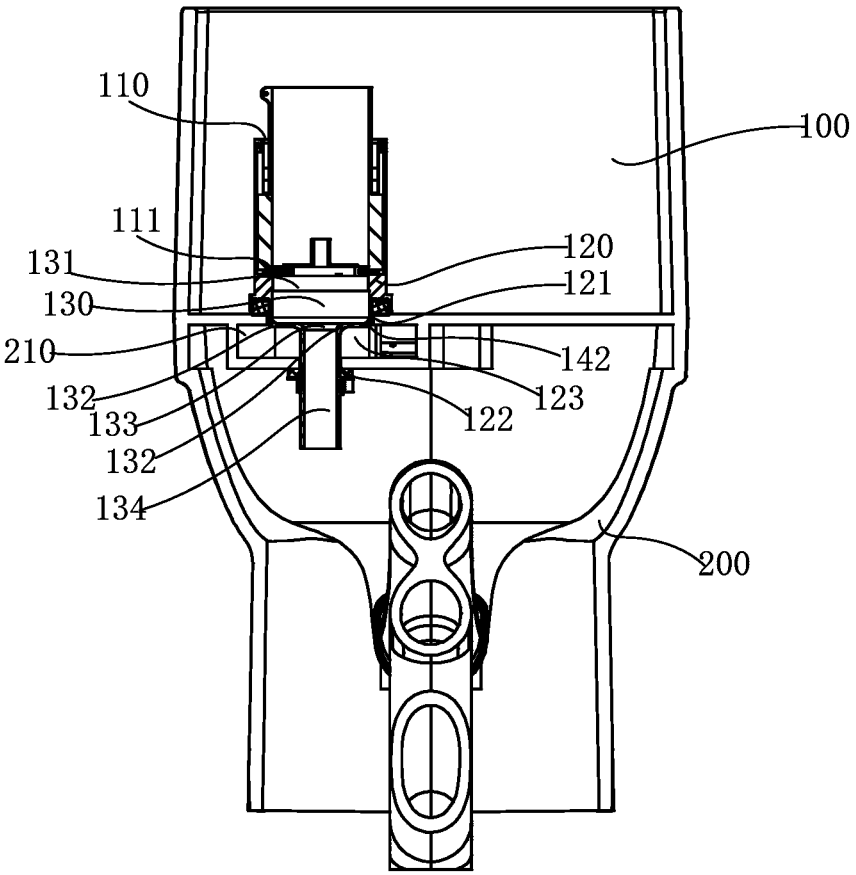
FIG. 10 is a schematic view of a sectional structure of the toilet drainage device provided by a seventh embodiment of the present disclosure.

As shown in FIGS. 1 and 10, some embodiments provide a toilet drainage device with gravitational reinforcement, which comprises a water tank 100 and a seat body 200. The water tank 100 of some embodiments is jointed above the seat body 200 and internally provided with a drain valve 110. The seat body 200 is internally provided with an edge channel 210 for scouring the inner wall of the toilet bowl and a jet channel for spraying towards the bottom of the toilet bowl (not illustrated). The mounting seat 120 of the drain valve 110 is fixedly disposed on the bottom wall of the water tank 100. The mounting seat 120 has a drainage channel 130. The drainage channel 130 is provided with a first water inlet 131, a first water outlet 132, and a second water outlet 133 communicating with each other, and the bottom end of the drainage channel 130 has a horizontal lower wall 142. The second water outlet 133 and the first water outlet 132 are respectively disposed at an intermediate portion and an outer periphery of the intermediate portion of the horizontal lower wall 142. The first water inlet 131 is in communication with the inner cavity of the water tank and is in sealed fit or separated fit with the watertight assembly 111 of the drainage valve 110. The first water outlet 132 communicates with one of the jet channel and the edge channel 210, and the second water outlet 133 communicates with the other of the jet channel and the edge channel 210. In some embodiments, the first water outlet 132 communicates with the edge channel 210, and the second water outlet 133 communicates with the jet channel.

Moreover, the bottom wall of the water tank 100 is provided with a first mounting hole 121 for mounting a mounting seat 120 of the drain valve 110, and the seat body 200 is also correspondingly provided with a second mounting hole 122 for mounting a mounting seat 120 of the drain valve 110. The first water inlet 131 is located above the first mounting hole 121, and the first water outlet 132 and the second water outlet 133 are juxtaposedly disposed between the first mounting hole 121 and the second mounting hole 122. The second water outlet 133 is provided with a downwardly extending extension channel 134, which protrudes from the second mounting hole 122 and communicates with the jet channel. A cavity 123 is formed between the first mounting hole 121 and the second mounting hole 122. There is provided with one or more first water outlets 132 are provided. In some embodiments, there are provided with two or more first water outlets 132 spacedly provided at an outer periphery of the second water outlet 133, which communicate with the edge channel 210 through the cavity 123.

In order to obtain a better flushing effect, in some embodiments, the jet channel has a cross-sectional area that is smaller than that of the first water inlet 131 of the drainage channel 130.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position, the first water outlet 132 corresponds to the edge channel 210 in position, and the second water outlet 133 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131. The water in the water tank 100 enters the drainage channel 130 through the first water inlet 131, and respectively produces a shunt at the first water outlet 132 and the second water outlet 133 on the horizontal lower wall of the drainage channel 130, so that one part of the water enters the edge channel 210 from the first water outlet 132, and the other part of the water flows into the extension channel 134 and enters the jet channel from the second water outlet 133.

It is necessary to explain that, the specific structure of the drainage channel 130 is designed into different shapes according to actual needs. The opening position of the first water outlet 132 is mainly matched with the structure and position of the edge channel 210 of the seat body 200.

Figure 11:
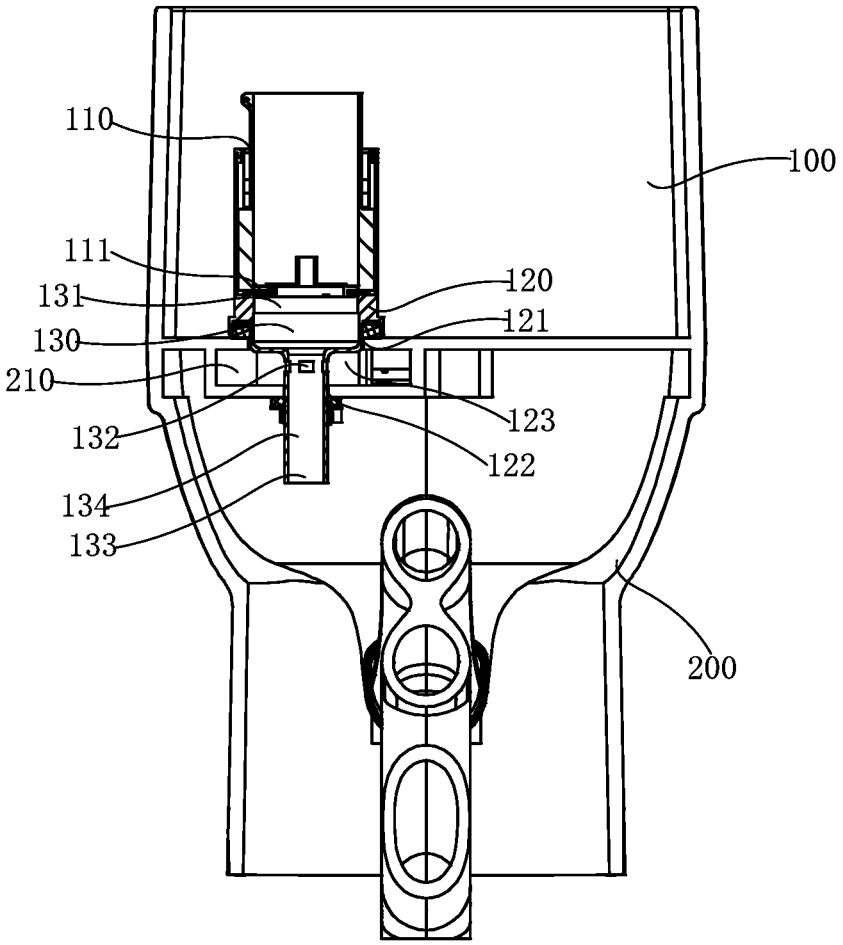
FIG. 11 is a schematic view of a sectional structure of the toilet drainage device provided by an eighth embodiment of the present disclosure.

As shown in FIGS. 1 and 11, some embodiments provide a supercharged toilet drainage device with two water outlets, which comprises a water tank 100 and a seat body 200. The water tank 100 of some embodiments is jointed above the seat body 200 and internally provided with a drain valve 110. The seat body 200 is internally provided with an edge channel 210 for scouring the inner wall of the toilet bowl and a jet channel for spraying towards the bottom of the toilet bowl (not illustrated). The mounting seat 120 of the drain valve 110 is fixedly disposed on the bottom wall of the water tank 100. The mounting seat 120 has a drainage channel 130 and an extension channel 134 connected below the drainage channel 130, and the extension channel 134 has a circulation section that is less than that of the drainage channel 130. The drainage channel 130 is provided with a first water inlet 131. The extension channel 134 is sequentially provided with a first water outlet 132, and a second water outlet 133 communicating with the first water inlet 131 from top to bottom. The first water inlet 131 is in communication with the inner cavity of the water tank and is in sealed fit or separated fit with the watertight assembly 111 of the drainage valve 110. The first water outlet 132 communicates with one of the jet channel and the edge channel 210, and the second water outlet 133 communicates with the other of the jet channel and the edge channel 210. In some embodiments, the first water outlet 132 communicates with the edge channel 210, and the second water outlet 133 communicates with the jet channel.

Moreover, the bottom wall of the water tank 100 is provided with a first mounting hole 121 for mounting a mounting seat 120 of the drain valve 110, and the seat body 200 is also correspondingly provided with a second mounting hole 122 for mounting a mounting seat 120 of the drain valve 110. The first water inlet 131 is located above the first mounting hole 121, and the first water outlet 132 is located between the first mounting hole 121 and the second mounting hole 122. The second water outlet 133 protrudes from the second mounting hole 122 and is located below the second mounting hole 122. A cavity 123 is formed between the first mounting hole 121 and the second mounting hole 122. There is provided with one or more first water outlets 132 are provided. In some embodiments, there are provided with two or more first water outlets 132 spacedly provided in a circumferential direction, which communicate with the edge channel 210 through the cavity 123.

In order to obtain a better flushing effect, in some embodiments, the jet channel has a cross-sectional area that is smaller than that of the first water inlet 131 of the drainage channel 130.

During the installation, the mounting seat 120 of the drain valve 110 having the drainage channel 130 is mounted between the first mounting hole 121 of the bottom wall of the water tank 100 and the second mounting hole 122 of the seat body 200, so that the first water inlet 131 at an upper end of the drainage channel 130 corresponds to the watertight assembly 111 of the drain valve 110 in position. In the extension channel 134, the first water outlet 132 corresponds to the edge channel 210 in position, and the second water outlet 133 corresponds to the jet channel in position.

In an initial state, the watertight assembly 111 of the drain valve 110 is in sealed fit with the first water inlet 131, and the water in the water tank 100 is at a full water level. During the drainage, the watertight valve 111 is operated so that the watertight assembly 111 is in separated fit with the first water inlet 131 of the drainage channel 130. The water in the water tank 100 enters the drainage channel 130 through the first water inlet 131, and enters the extension channel 134 from the bottom of the drainage channel 130, and then produces a shunt at the first water outlet 132 and the second water outlet 133 of the extension channel 134, so that one part of the water enters the edge channel 210 from the first water outlet 132, and the other part of the water enters the jet channel from the second water outlet 133.

It is necessary to explain that, the specific structure of the drainage channel 130 is designed into different shapes according to actual needs. The opening position of the first water outlet 132 is mainly matched with the structure and position of the edge channel 210 of the seat body 200.

In the description of the present disclosure, it is necessary to understand that, the azimuth or positional relations indicated by the terms "center", "longitudinal", "transverse", "front", "rear", "left", "right", "vertical", "horizontal", "top", "bottom", "within", "outside", which are based on the azimuth or positional relations illustrated by the drawings, are only for facilitating description of the present disclosure and simplifying the description, rather than indicating or implying that the device or element referred to has to present a particular azimuth, and be constructed and operated in a particular azimuth, so that it is not understood as limiting the protection scope of the present disclosure.

Finally, it should be explained that: the aforementioned embodiments are only used to describe the technical solution of the present disclosure rather than limiting the same; although detailed explanations are made to the present disclosure by referring to preferred embodiments, a common technical person in the art should understand that: it is still possible to make amendments to the embodiments of the present disclosure or make equivalent replacements to part of the technical features; without departing from the spirit and scope of the present disclosure, they should all be covered in the scope of the technical solution for which protection is sought in the present disclosure.

The invention claimed is:

1. A toilet drainage device, comprising:

a water tank (100);

a seat body (200) provided with an edge channel (210) and a jet channel; and a mounting seat (120) disposed at a bottom wall of the water tank (100) and provided with a first water inlet (131), a first water outlet (132) and a second water outlet (133) communicating with each other;

wherein the first water inlet (131) is switchable conducting or cutting off with an inner cavity of the water tank (100);

wherein one of the first water outlet (132) and the second water outlet (133) is in communication with the edge channel (210) and the other thereof is in communication with the jet channel;

wherein the bottom wall of the water tank (100) has a first mounting hole (121) for mounting the mounting seat (120), the seat body (200) has a second mounting hole (122) for mounting the mounting seat (120), the first water inlet (131) is located above the first mounting hole (121), the first water outlet (132) is located between the first mounting hole (121) and the second mounting hole (122);

wherein the second water outlet (133) is located between the first mounting hole (121) and the second mounting hole (122), or the second water outlet (133) is located below the second mounting hole (122).

2. The toilet drainage device according to claim 1, wherein the first water inlet (131) is located higher than the first water outlet (132) and the second water outlet (133), and the first water outlet (132) is located higher than the second water outlet (133) or flush with the second water outlet (133).

3. The toilet drainage device according to claim 1, wherein the mounting seat (120) comprises a drainage channel (130), at which the first water inlet (131), the first water outlet (132) and the second water outlet (133) are disposed.

4. The toilet drainage device according to claim 3, wherein the drainage channel (130) has a lateral wall which has a diverting wall (135) tilted inward from top to bottom, wherein the first water outlet (132) is disposed at the diverting wall (135), and the second water outlet (133) is disposed at a bottom end of the drainage channel (130).

5. The toilet drainage device according to claim 1, wherein the mounting seat (120) comprises a drainage channel (130) and an extension channel (134) in communication, wherein the first water inlet (131) is disposed at the drainage channel (130), the first water outlet (132) is disposed at the drainage channel (130) or the extension channel (134); the second water outlet (133) is disposed at the extension channel (134); a cross-sectional dimension of the extension channel (134) is smaller than that of the drainage channel (130).

6. The toilet drainage device according to claim 1, wherein the mounting seat (120) comprises a drainage channel (130), the drainage channel (130) comprising an outer sleeve (125) and an inner sleeve (124) that are nested, wherein at least one of a top end opening of the outer sleeve (125) and a top end opening of the inner sleeve (124) serves as the first water inlet (131), the first water outlet (132) is disposed at the outer sleeve (125), and the second water outlet (133) is disposed at the inner sleeve (124).

7. The toilet drainage device according to claim 6, wherein the first water inlet (131) is disposed at a top end of the outer sleeve (125), a top end of the inner sleeve (124) is lower than that of the outer sleeve (125), the inner sleeve (124) comprises an inner water inlet communicating with the first water inlet (131), the inner cavity of the inner sleeve (124) forms an internal drainage channel (138), a passing gap between the outer sleeve (125) and the inner sleeve (124) forms an external drainage channel (136), the first water outlet (132) is in communication with the external drainage channel (136), and the second water outlet (133) is in communication with the internal drainage channel (138).

8. The toilet drainage device according to claim 6, wherein the second water outlet (133) is disposed at a bottom end of the inner sleeve (124), and the first water outlet (132) is disposed at a bottom end or lateral wall of the outer sleeve (125).

9. The toilet drainage device according to claim 1, wherein the mounting seat (120) comprises a drainage channel (130), the drainage channel (130) comprises the first water inlet (131), the first water outlet (132) and the second water outlet (133), wherein the drainage channel (130) comprise a larger section channel (139) at an upper portion, a diverting channel (140) tilted inwardly from top to bottom and a smaller section channel (141) at a lower portion, the diverting channel (140) comprises an upper end connected to the larger section channel (139) and a lower end connected to the smaller section channel (141), the first water outlet (132) is disposed at a lateral wall of the smaller section channel (141), and the second water outlet (133) is disposed at a bottom end of the smaller section channel (141).

10. The toilet drainage device according to claim 1, wherein the mounting seat (120) comprises a drainage channel (130), the drainage channel (130) comprises the first water inlet (131), the first water outlet (132) and the second water outlet (133); the drainage channel (130) comprises a horizontal lower wall (142) at a bottom end, the second water outlet (133) is disposed at an intermediate portion of the horizontal lower wall (142), the first water outlet (132) is disposed at an outer periphery of the intermediate portion of the horizontal lower wall (142).

11. The toilet drainage device according to claim 10, wherein the second water outlet (133) is connected with a downwardly extending extension channel (134), which communicates with the jet channel.

12. The toilet drainage device according to claim 1, wherein the first water outlet (132) communicates with the edge channel (210), and the second water outlet (133) communicates with the jet channel.

13. The toilet drainage device according to claim 1, wherein a cavity (123) is between the first mounting hole (121) and the second mounting hole (122), and at least the first water outlet (132) communicates with the edge channel (210) through the cavity (123).

14. The toilet drainage device according to claim 1, wherein the jet channel has a cross-sectional area that is less than that of the first water inlet (131).

* * * * *